US006114684A

United States Patent [19]

Mc Guire

[11] Patent Number: 6,114,684

[45] Date of Patent: Sep. 5, 2000

[54] LASER LISTENING DEVICE DETECTOR

[76] Inventor: James F. Mc Guire, 2210 Eastmeadows Ct., Lakeland, Fla. 33813

[21] Appl. No.: 09/081,348

[22] Filed: May 19, 1998

[51] Int. Cl.[7] ..... G01J 1/42; H04R 19/00

[52] U.S. Cl. ..... 250/208.2; 250/208.4

[58] Field of Search ..... 250/208.2, 208.4, 250/226

[56] References Cited

U.S. PATENT DOCUMENTS 4,352,039 9/1982 Hagood et al. ..... 310/328

5,646,596 7/1997 Gumm ..... 340/573.1

*Primary Examiner*—John R Lee

*Assistant Examiner*—Glenn T Kinnear

*Attorney, Agent, or Firm*—Louis J. Brunoforte

[57] ABSTRACT

A laser listening device detector is provided including a window of a room and a jamming mechanism abutting the window for vibrating the same upon the actuation thereof. Such vibration imparts perturbations on light directed at the window for jamming a laser listening device which is transmitting the light.

11 Claims, 4 Drawing Sheets

FIG. 2
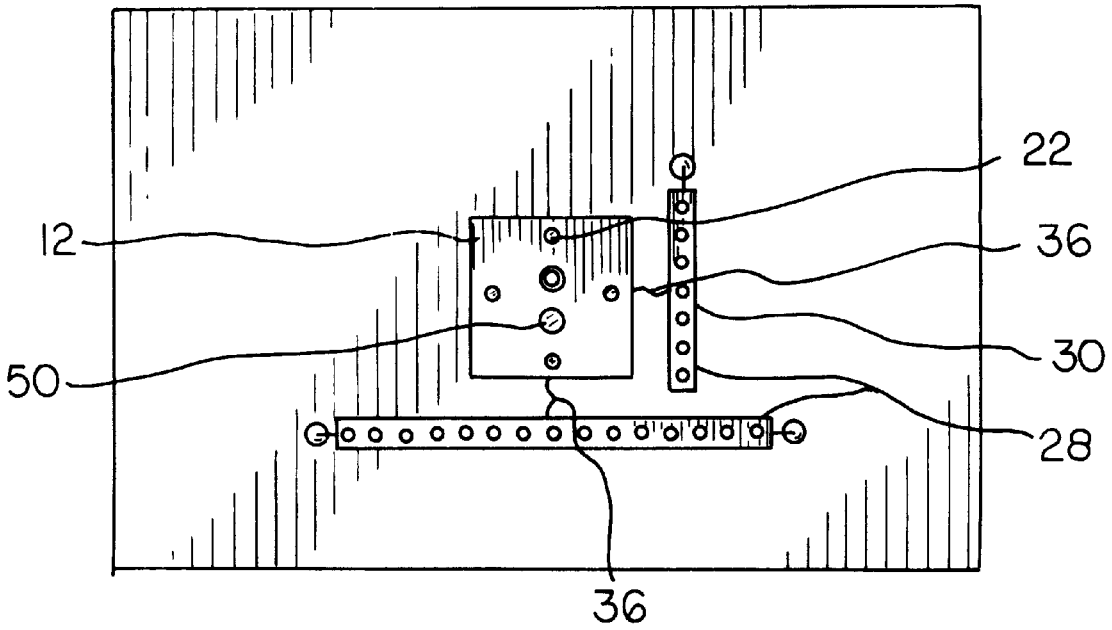
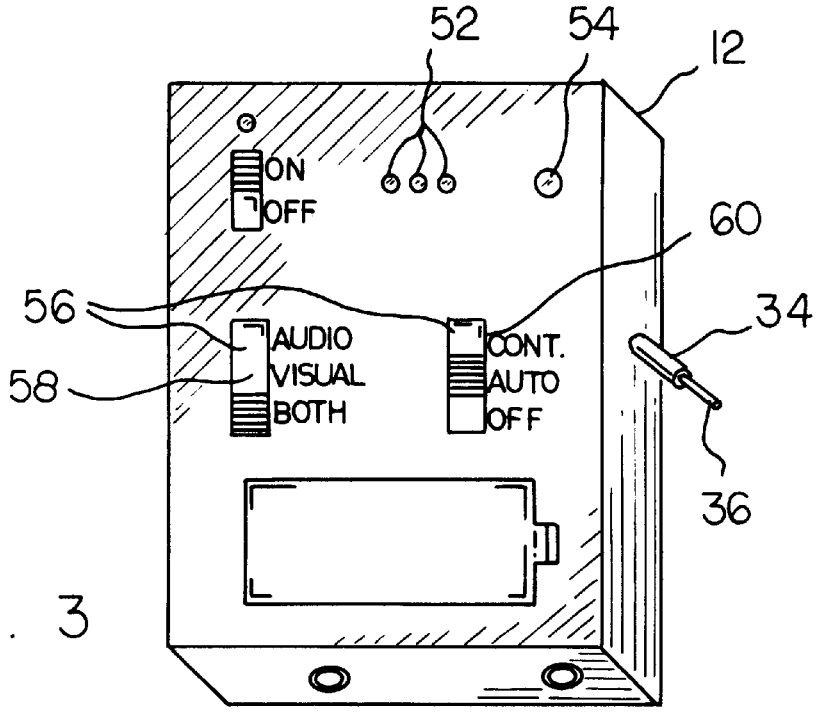
FIG. 3

LASER LISTENING DEVICE DETECTOR

BACKGROUND OF THE INVENTION

1. Field of the Invention

The present invention relates to a laser listening device detector and more particularly pertains to jamming a laser listening device and indicating the presence thereof.

2. Description of the Prior Art

The use of laser listening devices is known in the prior art. More specifically, laser listening devices heretofore devised and utilized for the purpose of eavesdropping on another party are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,533,131 to Kury discloses an anti-eavesdropping device; U.S. Pat. No. 5,424,718 to Muller et al. discloses an IR intrusion detector using scattering to prevent false alarms; U.S. Pat. No. 5,338,925 to Matthews discloses an apparatus for simultaneously detecting a plurality of discrete laser modulation frequencies having circuitry for background radiation canceling; U.S. Pat. No. 5,285,062 to Lee discloses a laser/detector hybrid with mirror source and diffracted return beam; U.S. Pat. No. 5,047,645 to Gundjian et al. discloses a thin film infrared laser detector and monitor; U.S. Pat. No. 4,829,729 to Derner et al. discloses an anti-eavesdropping window structure; U.S. Pat. No. 4,634,878 to Fricke discloses a laser detector with distance-to-beam strip sensor; U.S. Pat. No. 4,346,992 to Schwartz discloses a laser detector and spectral analyzer; and U.S. Pat. No. 4,019,056 to Block et al discloses an infrared laser detector employing a pressure controlled differential optoacoustic detector, which are each incorporated herein by reference.

In this respect, the laser listening device detector according to the present invention substantially departs from the conventional concepts and designs of the prior art, and in so doing provides an apparatus primarily developed for the purpose of jamming a laser listening device and indicating the presence thereof.

Therefore, it can be appreciated that there exists a continuing need for a new and improved laser listening device detector which can be used for jamming a laser listening device and indicating the presence thereof. In this regard, the present invention substantially fulfills this need.

SUMMARY OF THE INVENTION

In view of the foregoing disadvantages inherent in the known types of laser listening devices now present in the prior art, the present invention provides an improved laser listening device detector. As such, the general purpose of the present invention, which will be described subsequently in greater detail, is to provide a new and improved laser listening device detector which has all the advantages of the prior art and none of the disadvantages.

To attain this, the present invention essentially comprises a housing with a rectangular configuration. The housing has a rear face, a front face and a peripheral side wall formed therebetween defined by a top face, a bottom face and a pair of side faces. While the housing may be simply situated on a window by a single suction cup mounted thereon like that shown in FIG. 1, a mounting bracket may also be included. As shown in FIG. 4, the mounting bracket includes a planar rectangular bottom face and a pair of side faces extending upwardly from end edges of the bottom face. Each of the faces of the mounting bracket have a tab extending therefrom with a suction cup. In use, the mounting bracket is coupled to the bottom face of the housing with the side faces of the mounting bracket encompassing at least a portion of the side faces of the housing. The mounting bracket thus secures the housing to an inner surface of a window. As shown in FIG. 1, a rear face of the housing is facing and spaced from the window in use. Next provided is a plurality of photodiode detectors mounted on the rear face of the housing adjacent to each of the faces of the peripheral side wall thereof. Each photodiode detector has a filter mounted thereon for only passing light within a predetermined frequency range. In operation, the photodiode detectors serve to generate a detect signal upon the detection of light. FIG. 2 shows a plurality of elongated auxiliary detectors each including an elongated housing strip. Such strips have at least one suction cup mounted thereon for securing the strip to the inner surface of the window. Each strip further includes a plurality of auxiliary photodiode detectors having a filter mounted thereon. Similar to the photodiode detectors of the housing, those of the auxiliary strips are adapted for passing light within the predetermined frequency range such that the photodiode detectors may generate the detect signal upon the detection of light. For affording a connection between the auxiliary detectors and the housing, an auxiliary jack is mounted on one of the side faces of the housing. Such jack is adapted for releasably connecting with an adapter which is in turn connected to the auxiliary photodiode detectors via a wire. Note FIGS. 2 & 3. Situated within the housing is an amplifier connected to the auxiliary detectors via the auxiliary jack and further connected to the photodiode detectors of the housing. The amplifier further serves for amplifying the detect signal by a constant amount upon the receipt thereof. Connected to the amplifier is a comparator for passing the detect signal upon the same having a magnitude which is at least a predetermined amount. Next included is a jamming mechanism having a motor mounted within the housing. A rotor of the motor is equipped with an eccentrically mounted weight thereon. A rubber bumper is in communication with the weight and extends from the rear face of the housing at a central extent thereof. Such bumper abuts the inner surface of the window during use and further vibrates the window upon the actuation of the motor. Positioned on the front face of the housing is a light for illuminating upon the actuation thereof. Associated therewith is a speaker positioned on the front face of the housing for generating an audible signal upon the actuation thereof. A pair of slider switches are mounted on the front face of the housing and each have a first, second and third orientation. As shown in FIG. 3, the switches include an alarm mode switch and a jamming mode switch. Finally, control circuitry is situated within the housing and connected to the comparator, jamming mechanism, light, speaker and switches. In use, the control circuitry is adapted to actuate just the speaker, just the light, and both the speaker and light upon the receipt of the detect signal when the alarm mode switch is in the first, second and third orientation, respectively. Further, the control circuitry is further adapted to actuate the motor irrespective of the detect signal, actuate the motor only upon the receipt of the detect signal, and preclude the actuation of the motor when the jamming mode switch is in the first, second and third orientation, respectively.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved laser listening device detector which has all the advantages of the prior art laser listening devices and none of the disadvantages.

It is another object of the present invention to provide a new and improved laser listening device detector which may be easily and efficiently manufactured and marketed.

It is a further object of the present invention to provide a new and improved laser listening device detector which is of a durable and reliable construction.

An even further object of the present invention is to provide a new and improved laser listening device detector which is susceptible of a low cost of manufacture with regard to both materials and labor, and which accordingly is then susceptible of low prices of sale to the consuming public, thereby making such laser listening device detector economically available to the buying public.

Still yet another object of the present invention is to provide a new and improved laser listening device detector which provides in the apparatuses and methods of the prior art some of the advantages thereof, while simultaneously overcoming some of the disadvantages normally associated therewith.

Still another object of the present invention is to jam a laser listening device or indicate the presence thereof.

Lastly, it is an object of the present invention to provide a new and improved laser listening device detector including a window of a room and a jamming mechanism abutting the window for vibrating the same upon the actuation thereof. Such vibration imparts perturbations on light directed at the window for jamming a laser listening device which is transmitting the light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a rear view of the present invention showing the auxiliary detectors.

FIG. 3 is a front view of the housing of the present invention.

Similar reference characters refer to similar parts throughout the several views of the drawings.

DESCRIPTION OF THE PREFERRED EMBODIMENT

Figure 1:
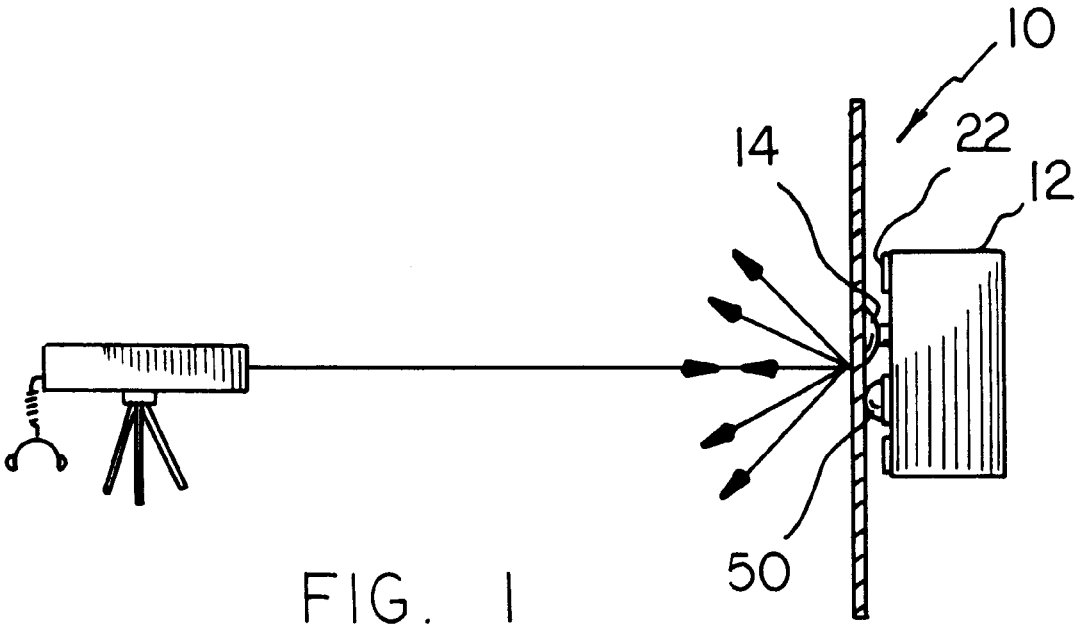
FIG. 1 is a side view of the preferred embodiment of the laser listening device detector constructed in accordance with the principles of the present invention.

With reference now to the drawings, and in particular to FIG. 1 thereof, a new and improved laser listening device detector embodying the principles and concepts of the present invention and generally designated by the reference numeral 10 will be described.

The present invention, the new and improved laser listening device detector, is comprised of a plurality of components. Such components in their broadest context include a jammer, indicator and a plurality of detectors. Such components are individually configured and correlated with respect to each other so as to attain the desired objective.

More specifically, it will be noted that the system 10 of the present invention includes a housing 12 with a rectangular configuration. The housing has a rear face, a front face and a peripheral side wall formed therebetween defined by a top face, a bottom face and a pair of side faces.

Figure 4A:
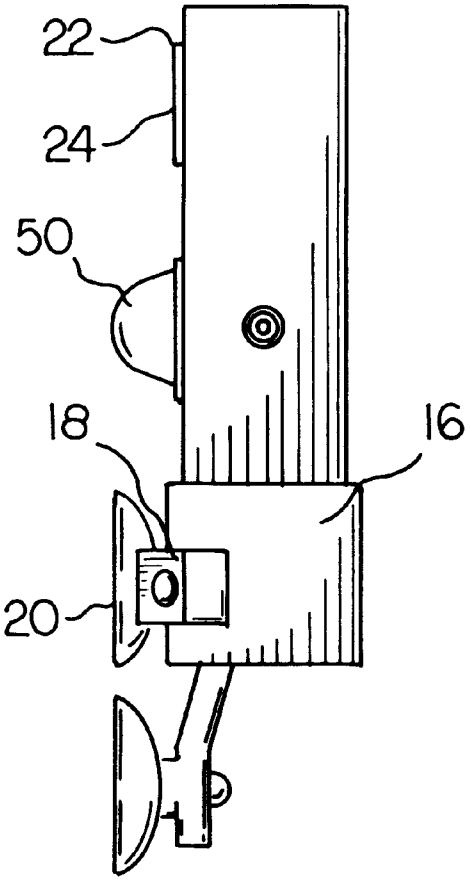
FIG. 4 is a rear view of the present invention with the mounting bracket.
Figure 4:
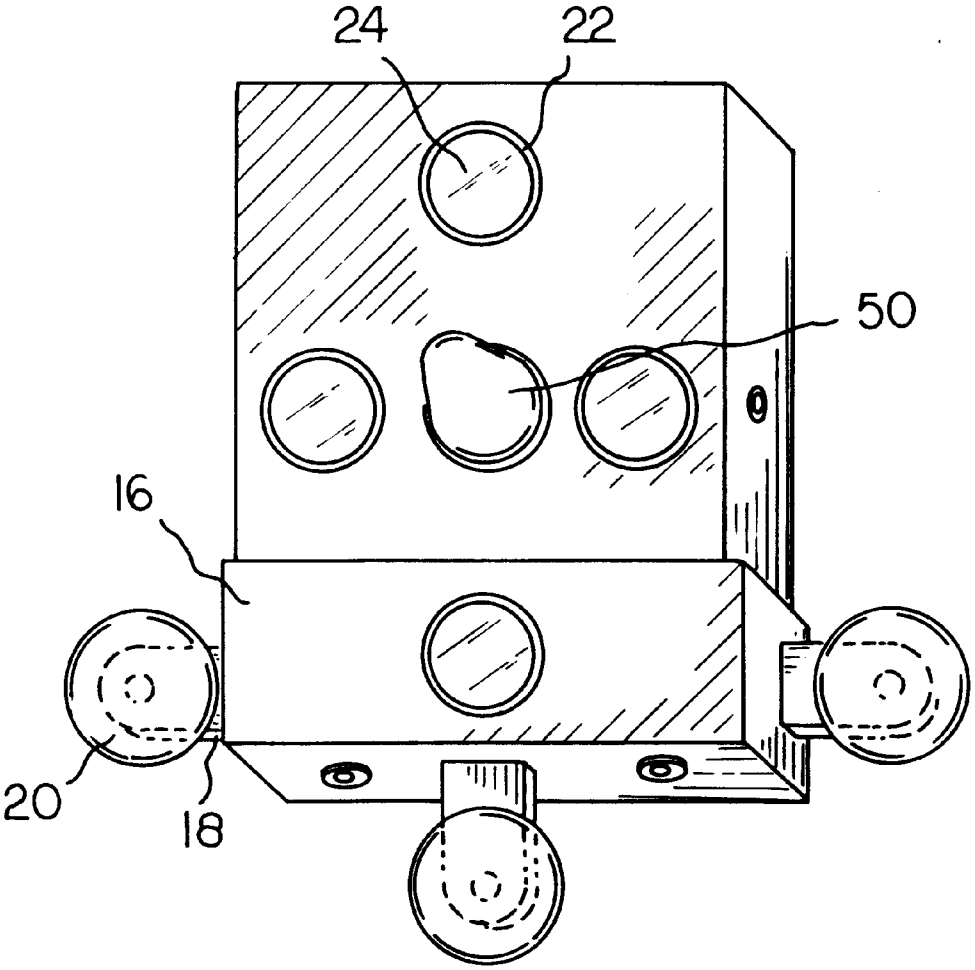

While the housing may be simply situated on a window by a single suction cup 14 mounted thereon like that shown in FIG. 1, a mounting bracket 16 may also be included. As shown in FIG. 4, the mounting bracket includes a planar rectangular bottom face and a pair of side faces extending upwardly from end edges of the bottom face. Each of the faces of the mounting bracket has a tab 18 extending therefrom with a suction cup 20.

In use, the mounting bracket is coupled to the bottom face of the housing with the side faces of the mounting bracket encompassing at least a portion of the side faces of the housing. The mounting bracket is thus capable of securing the housing to an inner surface of a window. As shown in FIG. 1, a rear face of the housing is facing and spaced from the window in use.

Next provided is a plurality of photodiode detectors 22 mounted on the rear face of the housing adjacent to each of the faces of the peripheral side wall. A hole may be formed in the mounting bracket for allowing the exposure of a bottom one of the photodiode detectors. Each photodiode detector has a filter 24 mounted thereon for only passing light within a predetermined frequency range. As an option, various magnification or manipulating properties may be afforded by way of a lens 26. In operation, the photodiode detectors serve to generate a detect signal upon the detection of light.

FIG. 2 shows a plurality of elongated auxiliary detectors 28 each including an elongated housing strip 30. Such strips have at least one suction cup mounted thereon for securing the strip to the inner surface of the window. Each strip further includes a plurality of auxiliary photodiode detectors having a filter mounted thereon. Similar to the photodiode detectors of the housing, those of the auxiliary detectors are adapted for passing light within the predetermined frequency range such that the photodiode detectors may generate the detect signal upon the detection of light. For reasons that will soon become apparent, the situation of the auxiliary detectors about the window is critical to ensure optimal detection of light.

Figure 5:
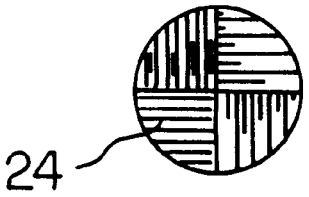
FIG. 5 is a close-up view of one of the filters associated with the photodiodes of the present invention.
Figure 6:
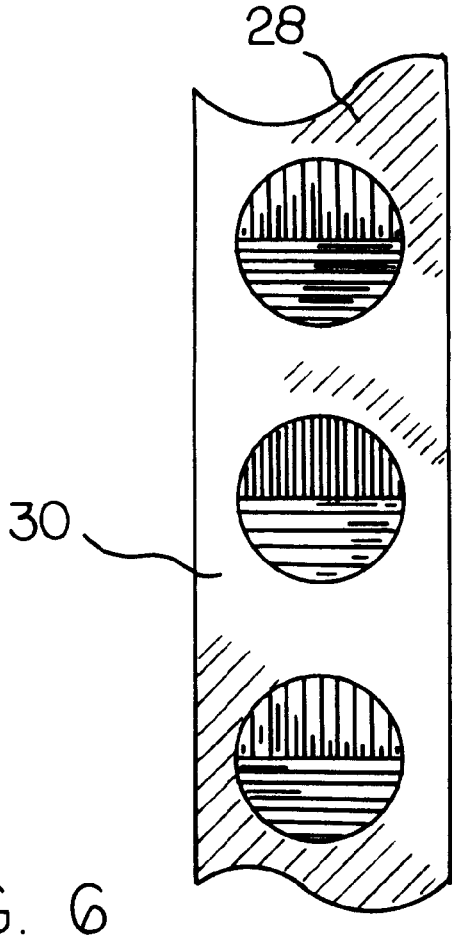
FIG. 6 is a front view of one of the housing strips associated with the auxiliary detectors of the present invention.

As shown in FIGS. 5 & 6, the filters may include various designs to filter unwanted frequencies(or wavelengths) of light. Preferably, a couple types of filters are employed with such different filters being mounted on the associated housing strip in an alternating manner. This affords optimum detection capabilities for reasons that will soon become apparent.

For affording a connection between the auxiliary detectors and the housing, an auxiliary jack 34 is mounted on one of the side faces of the housing. Such jack is adapted for releasably connecting with an adapter which is in turn connected to the auxiliary photodiode detectors via a wire 36. Note FIGS. 2 & 3. In an alternate embodiment, fiber optic cables may be used to direct light to the housing with a photodiode inside.

Figure 7:
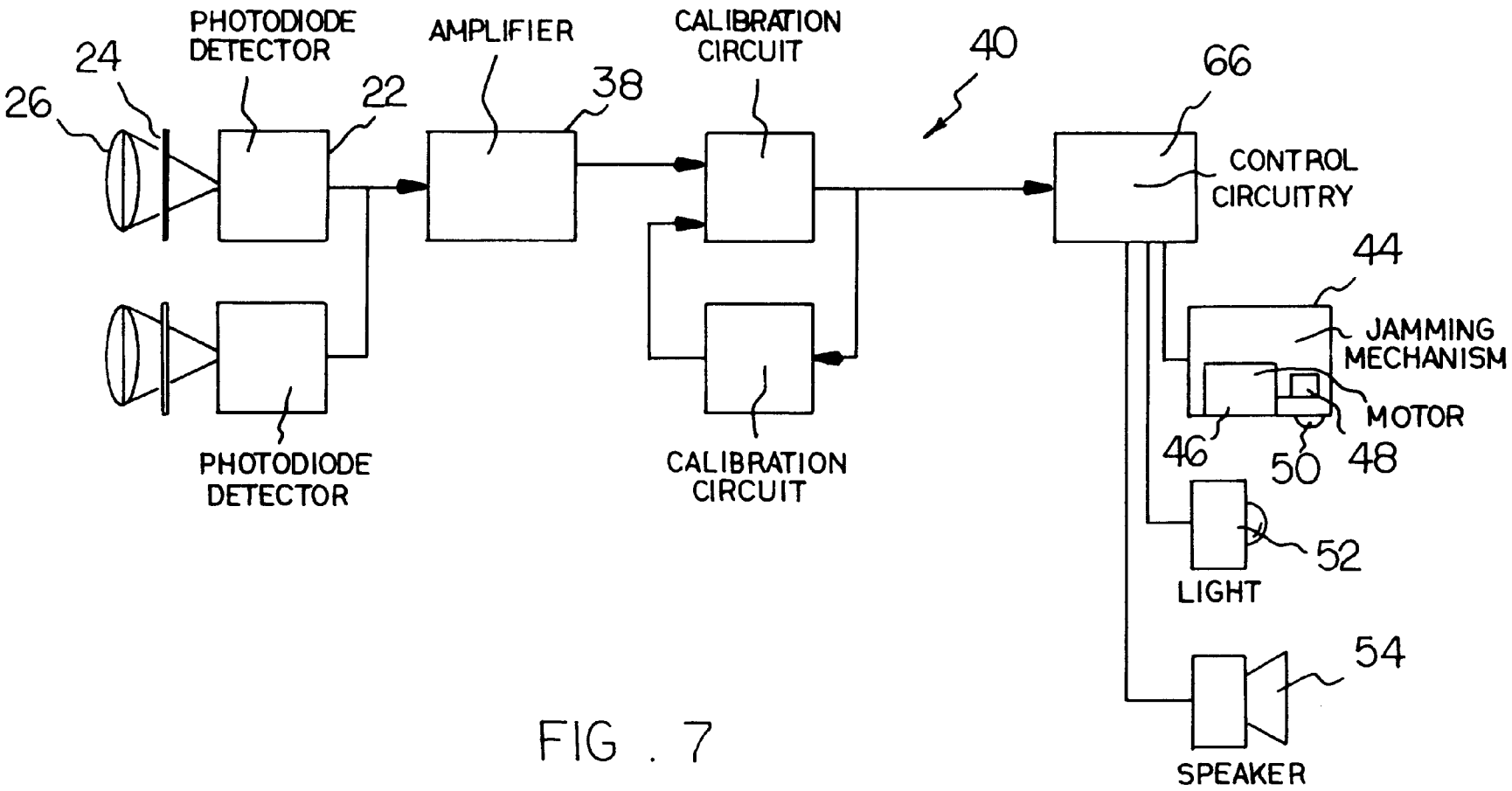
FIG. 7 is a schematic diagram of the present invention.

Situated within the housing is an amplifier 38 connected to the auxiliary detectors via the auxiliary jack and further connected to the photodiode detectors of the housing. The amplifier serves for amplifying the detect signal by a constant amount upon the receipt thereof. Connected to the amplifier is a comparator 40 for passing the detect signal upon the same having a magnitude which is at least a predetermined amount. As shown in FIG. 7, the comparator includes a calibration circuit 42 which has associated with it an unillustrated photoelectric cell for detecting a level of ambient light within the environment. By this means, the calibration circuit is adapted to adjust the aforementioned predetermined amount such that an increase in ambient light, or noise, would decrease the required magnitude of the detect signal. It should be noted that similar technology is employed in U.S. Pat. No. 5,521,696 to Dunne and U.S. Pat. No. 5,239,296 to Jenkins which are both incorporated herein by reference. As an option, electrical band pass filters may be included amongst the amplifier and comparator for working in conjunction with the light filters to further avoid inadvertent actuation of the present invention.

Next included is a jamming mechanism 44 having a motor 46 mounted within the housing. A rotor of the motor is equipped with an eccentrically mounted weight 48. A rubber bumper 50 is in communication with the weight and extends from the rear face of the housing at a central extent thereof. It should be noted that the motor and weight may be situated within housing and merely abut the bumper. In use, the bumper abuts the inner surface of the window during use and further vibrates the window upon the actuation of the motor. As an option, the motor may be adapted to vibrate the bumper at a constant frequency or varying, random frequencies. This vibration serves to prevent a laser of a laster listening device from performing its intended function. Such laser listening devices often employ a YAG laser or a semiconductor laser.

Positioned on the front face of the housing is a light 52 for illuminating upon being actuation. Associated therewith is a speaker 54 positioned on the front face of the housing for generating an audible signal when actuated. A pair of slider switches 56 are mounted on the front face of the housing and each have a first, second and third orientation. As shown in FIG. 3, the switches include an alarm mode switch 58 and a jamming mode switch 60.

Finally, control circuitry 66 is situated within the housing and connected to the comparator, jamming mechanism, light, speaker and switches. In use, the control circuitry is adapted to actuate just the speaker, just the light, and both the speaker and light upon the receipt of the detect signal when the alarm mode switch is in the first, second and third orientation, respectively. Further, the control circuitry is further adapted to actuate the motor irrespective of the detect signal, actuate the motor only upon the receipt of the detect signal, and preclude the actuation of the motor when the jamming mode switch is in the first, second and third orientation, respectively. The control circuitry is also equipped with a standard on/off switch and indicator light. Further, the present invention may be powered by a either a battery or a conventional power cable.

The present invention may thus serve as merely an indicator of a person eavesdropping. In the alternative, the present invention may also actively jam eavesdropping equipment by interfering with the detection of vibrations imparted on the window by a person speaking adjacent thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved laser listening device detector comprising, in combination:

a housing with a rectangular configuration having a rear face, a front face and a peripheral side wall formed therebetween defined by a top face, a bottom face and a pair of side faces;

a mounting bracket including a planar rectangular bottom face and a pair of side faces extending upwardly from end edges of the bottom face, the faces of the mounting bracket each having a tab extending therefrom with a suction cup coupled thereto, wherein the mounting bracket is coupled to the bottom face of the housing with the side faces of the mounting bracket encompassing at least a portion of the side faces of the housing for securing the housing to an inner surface of a window such that a rear face of the housing is facing and spaced from the window;

a plurality of photodiode detectors mounted on the rear face of the housing adjacent to each of the faces of the peripheral side wall thereof, each photodiode detector having a filter mounted thereon for only passing light within a predetermined frequency range, wherein the photodiode detectors each generate a detect signal upon the detection of light;

a plurality of elongated auxiliary detectors each including an elongated housing strip with at least one suction cup mounted thereon for securing the strip to the inner surface of the window, each strip further including a plurality of auxiliary photodiode detectors having a filter mounted thereon for passing light within the predetermined frequency range, wherein the auxiliary photodiode detectors each generate the detect signal upon the detection of light;

an auxiliary jack mounted on one of the side faces of the housing for releasably connecting with an adapter which is in turn connected to the auxiliary photodiode detectors via a wire;

an amplifier situated within the housing and connected to the auxiliary jack and the photodiode detectors of the housing for amplifying the detect signal by a constant amount upon the receipt thereof;

a comparator situated within the housing and connected to the amplifier for passing the detect signal upon the same having a magnitude which is at least a predetermined amount;

a jamming mechanism including a motor mounted within the housing and having a rotor with an eccentrically mounted weight thereon, wherein a rubber bumper is in communication with the weight and extends from the rear face of the housing at a central extent thereof for abutting the inner surface of the window during use and further vibrating the window upon the actuation of the motor;

a light positioned on the front face of the housing for illuminating upon the actuation thereof;

a speaker positioned on the front face of the housing for generating an audible signal upon the actuation thereof;

a pair of slider switches mounted on the front face of the housing and each having a first, second and third orientation, the switches including an alarm mode switch and a jamming mode switch; and a controller situated within the housing and connected to the comparator, jamming mechanism, light, speaker and switches, the controller adapted to actuate just the speaker, just the light, and both the speaker and light upon the receipt of the detect signal when the alarm mode switch is in the first, second and third orientation, respectively, the controller further adapted to actuate the motor irrespective of the detect signal, actuate the motor only upon the receipt of the detect signal, and preclude the actuation of the motor when the jamming mode switch is in the first, second and third orientation, respectively.

2. A laser listening device detector comprising:

a window of a room; and a jammer abutting the window for vibrating the same upon the actuation thereof, thereby imparting vibrations on a light directed at the window for jamming a laser listening device transmitting the light, wherein at least one detector is provided for actuating the jammer only upon the detection of light.

3. A laser listening device detector as set forth in claim 2 and further including an indicator for alerting a person within the room upon the detection of light by the detector.

4. A laser listening device detector as set forth in claim 2 wherein the detector is a photodiode detector.

5. A laser listening device detector as set forth in claim 2 wherein a plurality of detectors are included and spacedly situated about the window.

6. A laser listening device detector as set forth in claim 2 wherein a threshold sensor allows the actuation of the jammer only upon a magnitude of the light detected surpassing a predetermined amount.

7. A laser listening device detector as set forth in claim 3 wherein a mode selector allowing the selective deactuation of at least one of the jammer and the indicator.

8. A laser listening device detector as set forth in claim 3 wherein the indicator produces a visual signal.

9. A laser listening device detector as set forth in claim 3 wherein the indicator produces an audible signal.

10. A laser listening device detector as set forth in claim 4 wherein a filter is situated over the detector for allowing the message of light of a predetermined range of wavelengths.

11. A laser listening device detector comprising:

a window of a room;

a jammer, including a motor with an eccentrically mounted weight, abutting the window for vibrating the same upon the actuation thereof, thereby imparting vibrations on a light directed at the window for jamming a laser listening device transmitting the light; and means to activate and deactivate the motor to selectively rotate the eccentrically mounted weight for activating and deactivating the jammer.

* * * * *